US011053034B1

(12) United States Patent
Sikora et al.

(10) Patent No.: US 11,053,034 B1
(45) Date of Patent: Jul. 6, 2021

(54) STRAPPING TENSIONING TOOL

(71) Applicant: Golden Bear LLC, Columbus, OH (US)

(72) Inventors: Joshua Robert Sikora, Columbus, OH (US); Pavlo Vsevirovich Barlasov, San Jose, CA (US)

(73) Assignee: Golden Bear LLC, Columbus, OH (US)

( * ) Notice: Subject to any disclaimer, the term of this patent is extended or adjusted under 35 U.S.C. 154(b) by 122 days.

(21) Appl. No.: 16/272,153

(22) Filed: Feb. 11, 2019

(51) Int. Cl.
*B65B 13/18* (2006.01)
*B65B 13/02* (2006.01)

(52) U.S. Cl.
CPC ..... *B65B 13/186* (2013.01); *B65B 13/025* (2013.01); *B65B 13/184* (2013.01); *B65B 13/187* (2013.01)

(58) Field of Classification Search
CPC ..... B65B 13/22; B65B 13/186; B65B 13/025; B65B 13/184; B65B 13/187
USPC ..... 100/29, 32; 254/199–263
See application file for complete search history.

(56) References Cited

U.S. PATENT DOCUMENTS 6,047,742 A * 4/2000 Barlasov ..... B65B 13/025 140/123.6
8,578,997 B2 * 11/2013 Rauch ..... B65B 13/32 156/494
2019/0185189 A1 * 6/2019 Neeser ..... B65B 13/22

* cited by examiner

*Primary Examiner* — Shelley M Self
*Assistant Examiner* — Teresa A Guthrie
(74) *Attorney, Agent, or Firm* — The Law Office of Patrick F. O'Reilly, III, LLC

(57) ABSTRACT

Strapping tensioning tools are disclosed herein. The disclosed strapping tensioning tools reduce the forces that are required to be applied by an actuator (i.e., a motor) to release the tools from tensioned straps without damaging the straps. According to one aspect of the invention, the forces are reduced by the relative positioning, from front to back, of the cutter, the gripper and the windlass. According to a second aspect of the invention, the forces are reduced by reducing the angle formed between the gripper and the base of the tool. Namely, in one embodiment, the angle of the gripper relative to the strapping surface of the base is approximately 45-55 degrees.

13 Claims, 6 Drawing Sheets

SECTION A-A

SECTION B-B

STRAPPING TENSIONING TOOL

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

Technical Field

The present invention generally relates to strapping or packaging tools. More particularly, the present invention relates to a strapping or packaging tool that for securing packages, such as boxes, using cord or plastic strapping.

Background and Description of Related Art

Various tools are known in the packaging art for performing numerous functions related to the manipulation of strapping, which is commonly used as a closing mechanism for packages, and as a convenient means for easily attaching two objects to one another (e.g., attaching a box to a pallet). In conventional tools, a large vertical force must be applied to the lower strap to hold the strap in place during the performance of the strapping operations on the strap. Using conventional tools, the large vertical force makes it difficult for an operator to lift a gripper portion of the tool from the tensioned lower strap once the strapping is tensioned and then cut.

Therefore, what is needed is a packaging tool that reduces the vertical forces applied by the gripper to the strapping so as to facilitate lifting the gripper once the strapping is tensioned and then cut. A need also exists for a packaging tool that retains the holding ability of the gripper, while at the same time, decreases the force that is needed for lifting the gripper, and does not damage the strap.

SUMMARY OF EXAMPLE EMBODIMENTS

Accordingly, the present invention is directed to a strapping tensioning tool that substantially obviates one or more problems resulting from the limitations and deficiencies of the related art.

In accordance with one aspect of one or more embodiments of the present invention, there is provided a strapping tool comprising: a gripper, a windlass, a cutter, and a base. The base comprises a front and a rear, and the base is configured to receive the gripper, the windlass and the cutter. The base is further configured to retain the gripper, the windlass and the cutter disposed in relation to one another such that the cutter is closest to the front of the base, the windlass is closest to the rear of the base and the gripper is disposed between the cutter and the windlass.

In accordance with another aspect of one or more embodiments of the present invention, there is provided a strapping tool comprising a gripper, a cutter, and a base. The base is configured to receive the gripper and the cutter. The base is further configured to retain the gripper in relation to the base such that the gripper forms an angle of between 45-55 degrees with respect to a strapping surface of the base.

In accordance with yet another aspect of one or more embodiments of the present invention, there is provided a strapping tool comprising a gripper, a windlass, a cutter, and a base. The base comprises a front and a rear, and the base is configured to receive the gripper, the windlass and the cutter. The base is further configured to retain the gripper, the windlass and the cutter disposed in relation to one another such that the cutter is closest to the front of the base, the windlass is closest to the rear of the base and the gripper is disposed between the cutter and the windlass. The base is still further configured to retain the gripper in relation to the base such that the gripper forms an angle of between 45-55 degrees with respect to a strapping surface of the base.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE DRAWINGS

The invention will now be described, by way of example, with reference to the accompanying drawings, which are incorporated in and constitute a part of the specification, in which.

DRAWING REFERENCE NUMERALS

Figure 1:
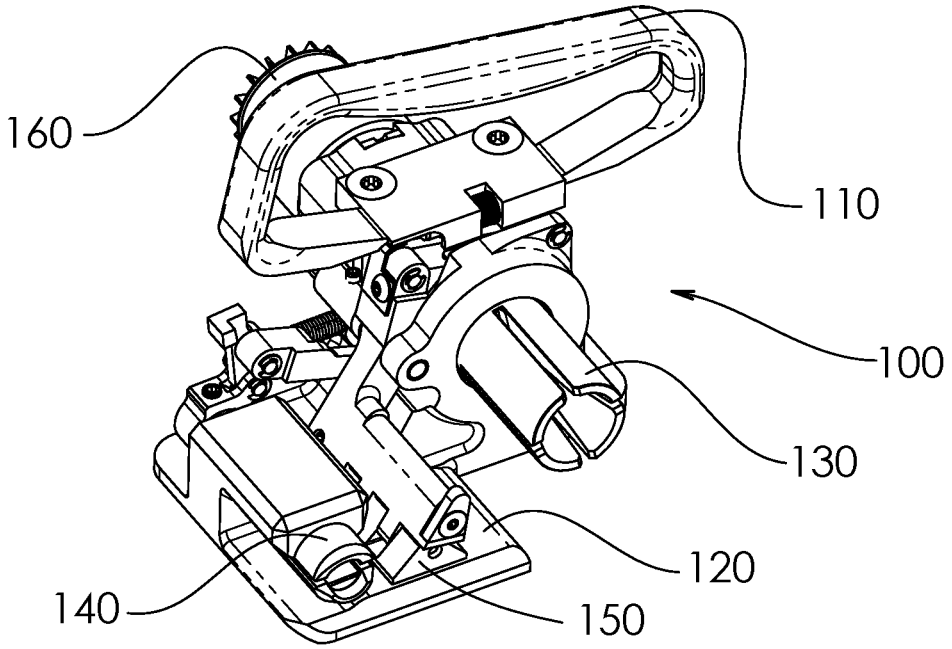
FIG. 1 is an orthographic 3D view of an example strapping tensioning tool according to the present application.

The following reference characters identify the associated elements depicted in the drawings describing the present invention:

| | | | |
|---|---|---|---|
| 100 | Strapping Tensioning Tool | 158 | Socket Set Screw |
| 110 | Handle | 159 | Compression Spring |
| 111 | Proximity Sensor | 160 | Motor |
| 112 | Side-Mount External Retaining Ring | 161 | Pinion |
| 113 | Knurled Ring | 162 | Torx Socket Head Cap Screw |
| 114 | Side-Mount External Retaining Ring | 163 | Extension Spring |
| 120 | Base | 164 | Extension Spring |
| 121 | Compression Spring | 165 | Support |
| 122 | Set Screw | 166 | Spring Pin 2 |
| 130 | Windlass Shaft | 167 | Needle Roller Bearing |
| 132 | Full Complement Needle-Roller Bearing | 168 | Torx Flat Head Screw |
| 133 | Dowel Pin | 170 | Ring |
| 134 | Main Pin | 171 | Long Lever |
| 135 | Pin 8 | 172 | Pawl |
| 136 | Pin 6 | 173 | Grip Arm |
| 140 | Cutter | 174 | Compression Spring |
| 142 | Cutter Screw | 175 | Spring Pin |
| 150 | Gripper Foot | 176 | Upper Ring Pin |
| 152 | Gripper Holder | 177 | Lower Ring Pin |
| 154 | Guide | 180 | Cutter Lever |
| 156 | Torx Drive Flat Head Screw | 182 | Lever Short |
| 186 | Torx Button-Head Cap Screw | 184 | Bracket |
| 188 | Pin 9 | 226 | Fourth Force Vector |
| 200 | Package | 228 | Fifth Force Vector |
| 210 | Strap | 230 | Sixth Force Vector |
| 220 | First Force Vector | 232 | Seventh Force Vector |
| 222 | Second Force Vector | 234 | Angle Between Gripper Holder and Base |
| 224 | Third Force Vector | | |

DETAILED DESCRIPTION

Figure 5:
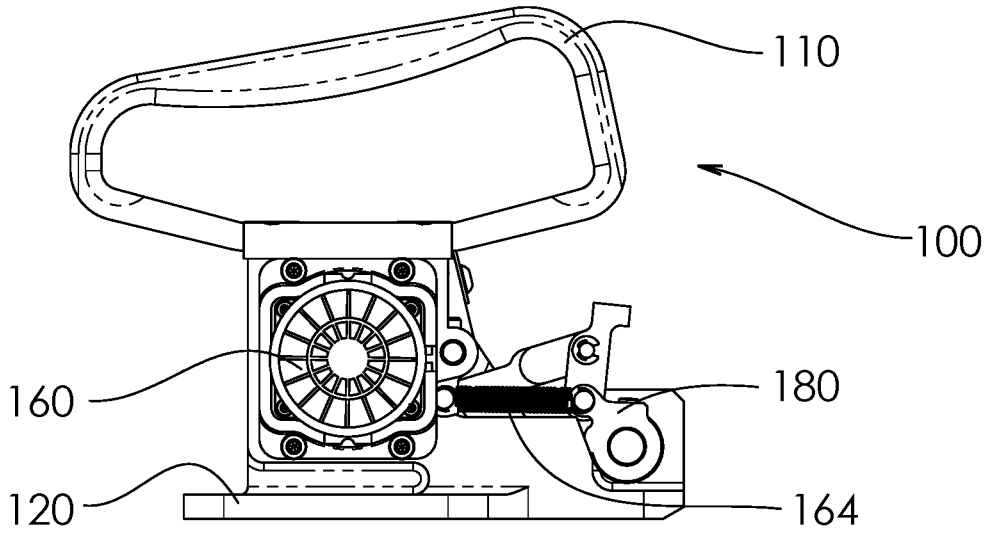
FIG. 5 is a right side view of the example strapping tensioning tool.
Figure 6:
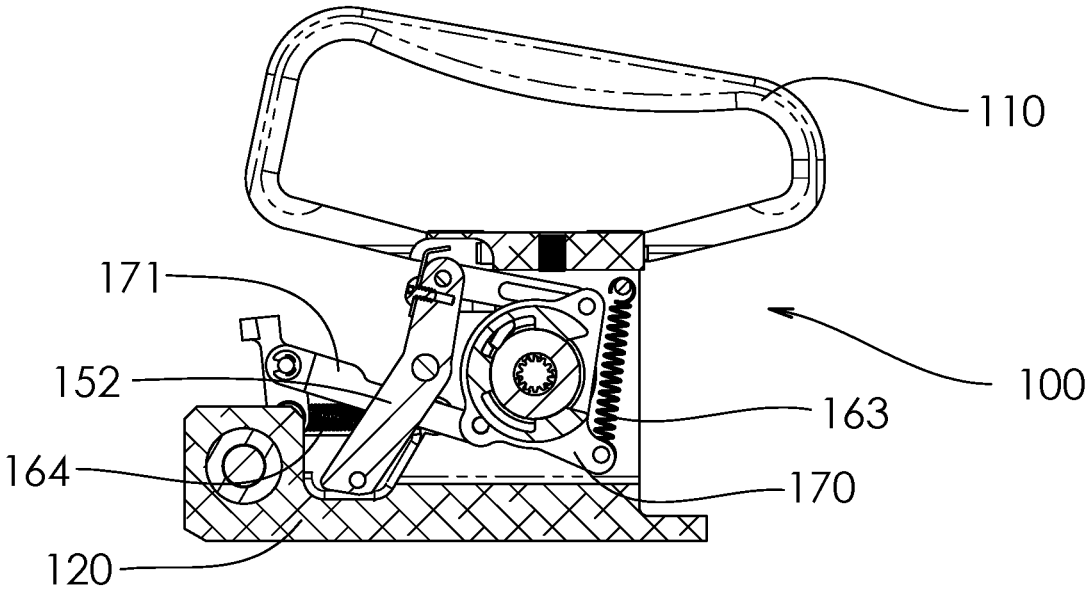
FIG. 6 is a cutaway, left side view of the example strapping tensioning tool.
Figure 7:
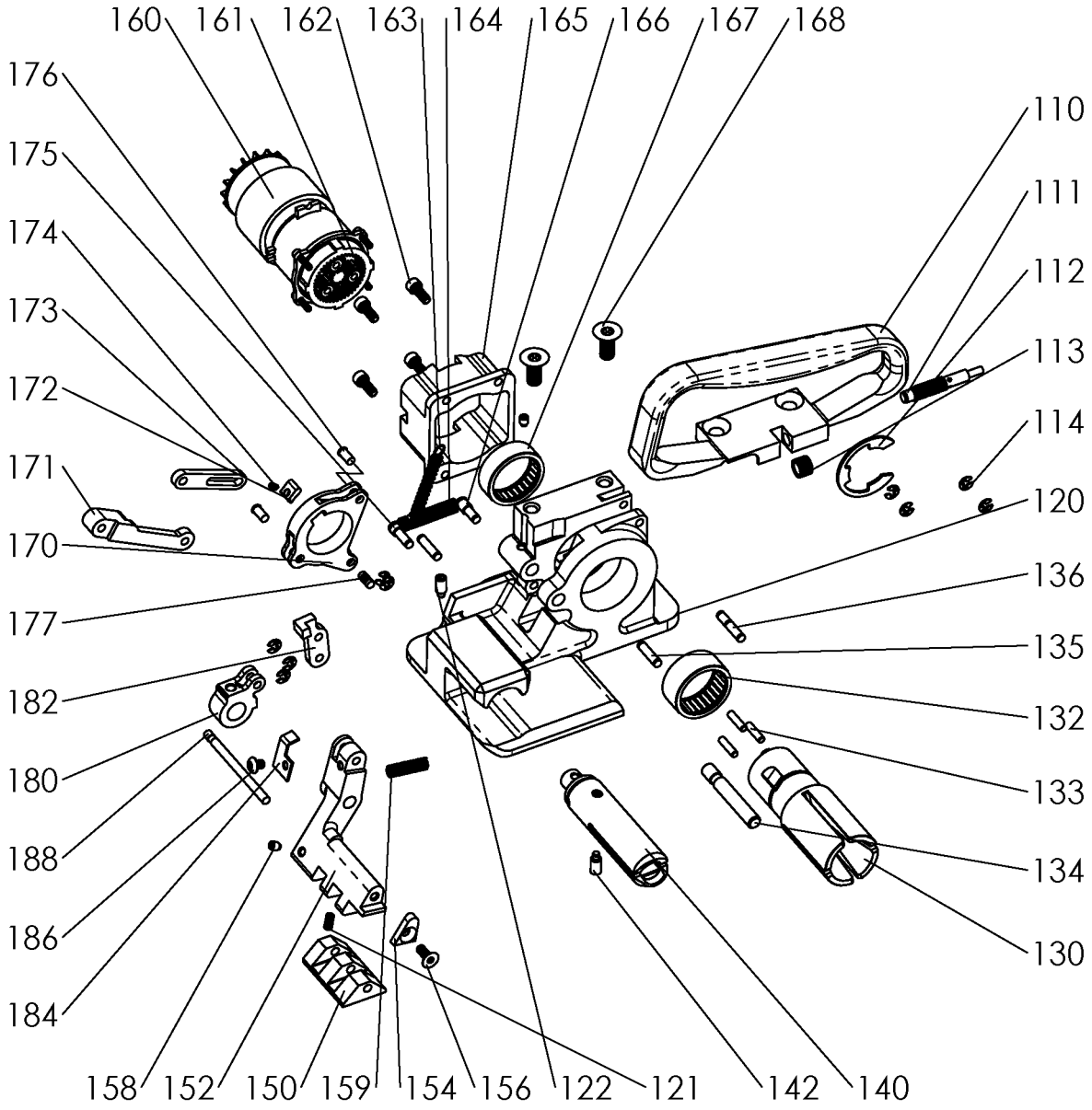
FIG. 7 is an exploded view of the example strapping tensioning tool.

An embodiment of a strapping tensioning tool according to the present application is illustrated in FIGS. 1-11. Referring to FIG. 1, there is illustrated an orthographic 3D view of example strapping tensioning tool 100 which comprises a handle 110 attached to a frame or base 120. The handle 110 is attached to the base 120 by screws 168 (see FIG. 7). The tool 100 further comprises a windlass shaft 130, a cutter 140 and a gripper foot 150. The windlass shaft 130, the cutter 140 and the gripper foot 150 are attached to and retained by the base 120. As illustrated, the front of tool 100 is toward the left side of FIG. 1 and the rear is toward the right side of FIG. 1. With respect to one another, the cutter 140 is disposed toward the front of tool 100; windlass shaft 130 (including motor 160) is disposed toward the rear of base 120; and the gripper foot 150 is disposed between the cutter 140 and windlass shaft 130. As shown in FIG. 7, the windlass shaft 130 is held in place by the side-mount external retaining ring 112. The windlass shaft 130 is rotationally supported on needle roller bearings 132 and 167 (see FIG. 7). The windlass shaft 130 is driven by the motor 160 by means of pinion gears 161 of the planetary gear box. The dowel pins 133 connect the pinion gears 161 of the planetary gear box to the windlass shaft 130. The support 165 connects the motor 160 with the base 120 (see FIG. 7). The support 165 is secured to the base 120 by screws 162.

Figure 2:
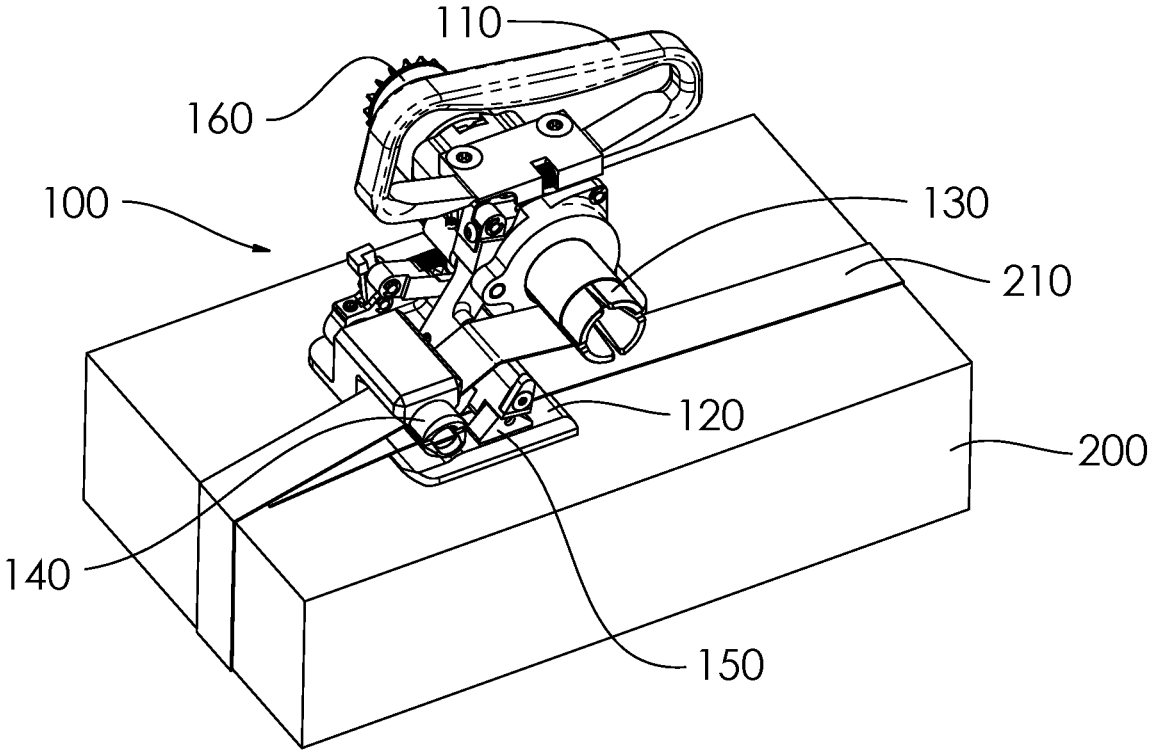
FIG. 2 is an orthographic 3D view of the example strapping tensioning tool in operation.
Figure 3:
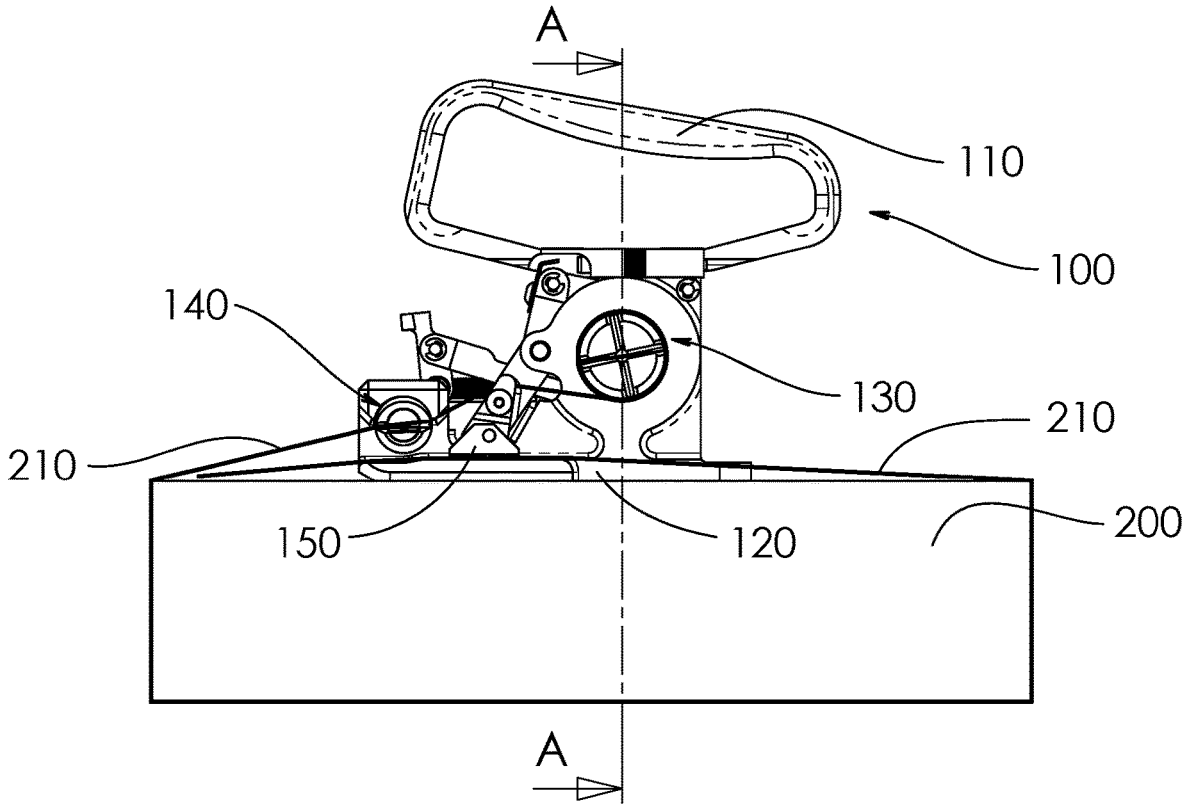
FIG. 3 is a left side view of the example strapping tensioning tool in operation.
Figure 4:
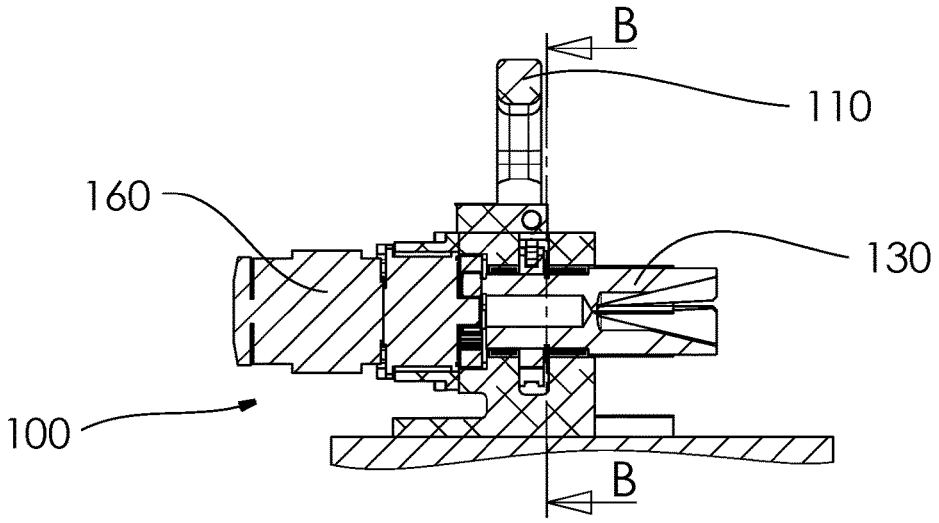
FIG. 4 is a cutaway, front view of the example strapping tensioning tool.

Referring now to FIG. 2, there is illustrated an orthographic 3D view of tool 100 in operation. Tool 100 is illustrated applying strapping 210 to package 200. Of course, tool 100 may also be suitable for tightening strapping around multiple packages or other objects, such as strapping boxes to a pallet. FIG. 3 is a left side view of the example strapping tensioning tool 100 in operation. FIG. 3 illustrates the path of strapping 210 during the operation of tool 100. As illustrated, a lower portion of strapping 210 runs under cutter 140, under gripper foot 150, and around package 200. An upper portion of strapping 210 continues through cutter 140 over gripper holder 152 and around windlass shaft 130. Cutaway section A-A of tool 100 is illustrated in FIG. 4.

Referring now to FIG. 5, there is illustrated a right side view of the example strapping tensioning tool 100. From the right side, motor 160, cutter lever 180 and extension spring 164 are more clearly illustrated. The cutter lever 180 is connected to the cutter 140 by set screw 122 (see FIG. 7). Cutaway section B-B of tool 100, depicted in FIG. 4, is illustrated in FIG. 6. In FIG. 6, gripper holder 152 is illustrated. Gripper holder 152 is configured to attach to gripper foot 150 which holds the lower portion of strapping 210. The gripper holder 152 pivots about the main pin 134 (see FIG. 7). The main pin 134 passes through the middle of the gripper holder 152, and pivotally connects the gripper holder 152 to the base 120. The gripper foot 150 is pivotally coupled to the gripper holder 152 by pin 188. The pin 188 is held in place inside the gripper holder 152 by set screw 158. The compression spring 159 creates the initial pressure of the gripper 150, 152 towards the strap. Gripper holder 152 is further operative to guide the upper portion of strapping 210 from the windlass shaft 130 to cutter 140. The cutter screw 142 connects the stationary portion of the cutter 140 to the base 120. The guide 154 prevents the strap from moving out of the cutter 140, and the guide 154 is secured to the side of the gripper holder 152 by screw 156. FIG. 6 further illustrates ring 170, extension springs 163 and 164, and long lever 171. The extension springs 163 and 164 return the ring 170 to its initial position after the strap is cut (see FIG. 7). The long lever 171 is operatively coupled to the cutter 140, and moves the cutter 140 to its initial position together with the short lever 182. The grip arm 173 operatively couples the gripper holder 152 to the ring 170 so that the gripper foot 150 is able to be actuated by the motor 160. The pins 135, 136, 166, 175, 176, 177 connect the springs 163, 164 and the grip arm 173 with the ring 170. The pins 135, 136, 166, 175, 176, 177 are held in place by side-mount external retaining rings 114. The compression spring 121 returns the gripper foot 150 back to its horizontal position so as to enable the lower portion of strapping 210 to be loaded into the tool 100.

Now, turning again to the exploded view of FIG. 7, the internal components of the example strapping tensioner 100 are illustrated. All of the illustrated components are identified in the list of reference numerals set forth above.

As shown in FIG. 7, the example strapping tensioning tool 100 further comprises a proximity sensor 111 that is configured to provide a signal to the motor 160 for controlling operation of the tool 100. More particularly, the proximity sensor 111 provides a stop signal to the motor 160 depending on the position of the gripper foot 150 and the gripper holder 152. The proximity sensor 111 is held in place by the knurled ring 113. Also, referring to FIG. 7, the bracket 184 provides information to the proximity sensor 111 that the gripper 150, 152 is already raised. The bracket 184 is secured to the gripper holder 152 by screw 186.

During the operation of the strapping tensioning tool 100, when the motor 160 rotates in the first direction, the motor 160 tensions the strap. Conversely, when the motor 160 rotates in the second direction, it cuts the strap by means of components 171, 172, and 180. The power from the motor 160 is initially transferred to the windlass shaft 130, and then the power is transferred through the pawl 172 to the ring 170, and then finally from the long lever 171 to the cutter 140. With reference to FIG. 7, the compression spring 174 is operated with the pawl 172.

Figure 8:
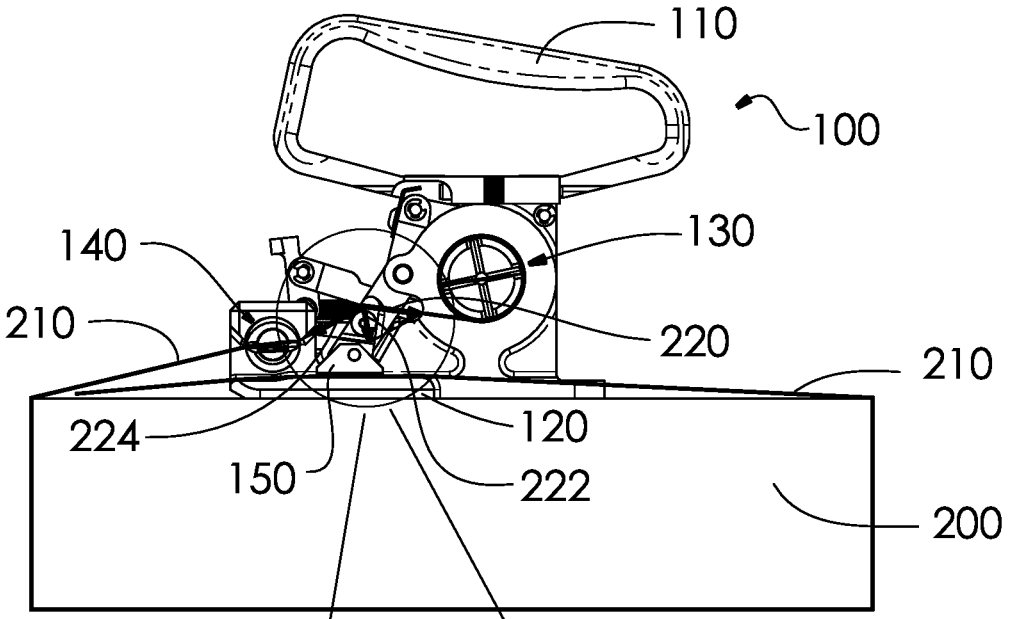
FIG. 8 is a left side view of the example strapping tensioning tool in operation showing vectors representing forces associated with the upper portion of the strapping.

Referring now to FIG. 8, there is illustrated a left side view of the example strapping tensioning tool 100. FIG. 8 illustrates the forces in operation showing vectors representing forces applied by the upper portion of the strapping 210. As more clearly shown in the enlarged view of FIG. 9, the forces applied to tool 100 by the upper portion of strapping 210 are depicted as vectors 220, 222, and 224. The tensile force of the upper strapping portion running through cutter 140 is depicted as vector 224. The upper strapping portion between cutter 140 and windlass shaft 130 applies the generally vertical force depicted as vector 222 to the gripper holder 152, which advantageously supplements the vertical force applied by the gripper foot 150 to the lower strapping portion such that the force applied to the gripper foot 150 may be reduced. The tensile force of the strapping portion between gripper holder 152 and windlass shaft 130 is depicted as vector 220.

During a tensioning operation of the tool 100, as shown in FIGS. 2, 3, 8, and 10 the lower portion of the strap 210 is situated under the gripper 150, 152. The upper portion of the strap 210 is threaded thru the cutter 140 and thru the windlass 130. To tension the strap 210, the motor 160 rotates the windlass 130 in a first direction (i.e., counter-clockwise direction) and applies a tension force to the upper portion of the strap 210. Gripper 150, 152 is holding the lower portion of the strap 210. The gripper 150, 152 needs to hold as much force as the windlass 130 can create. In the example tool 100, the primary vertical force applied by the gripper foot 150 is able to be reduced as a result of the primary vertical force being supplemented by the generally vertical force 222 applied by the upper strapping portion. After tensioning of the strap 210 is complete, the operator (i.e., motor 160) rotates in a second direction (i.e., clockwise direction), and cuts the strap 210 using the cutter 140. After strap 210 is cut, the gripper 150, 152 remains in the position with the vertical force 226 applied to the strap until the gripper 150, 152 is lifted by the further clockwise rotation of the motor 160, but the supplemental vertical force 222 is zero once the strap 210 is cut, thus making it much easier for the motor 160 to lift the gripper 150, 152. Also, the example tool 100 does not damage the strap 210.

Figure 10:
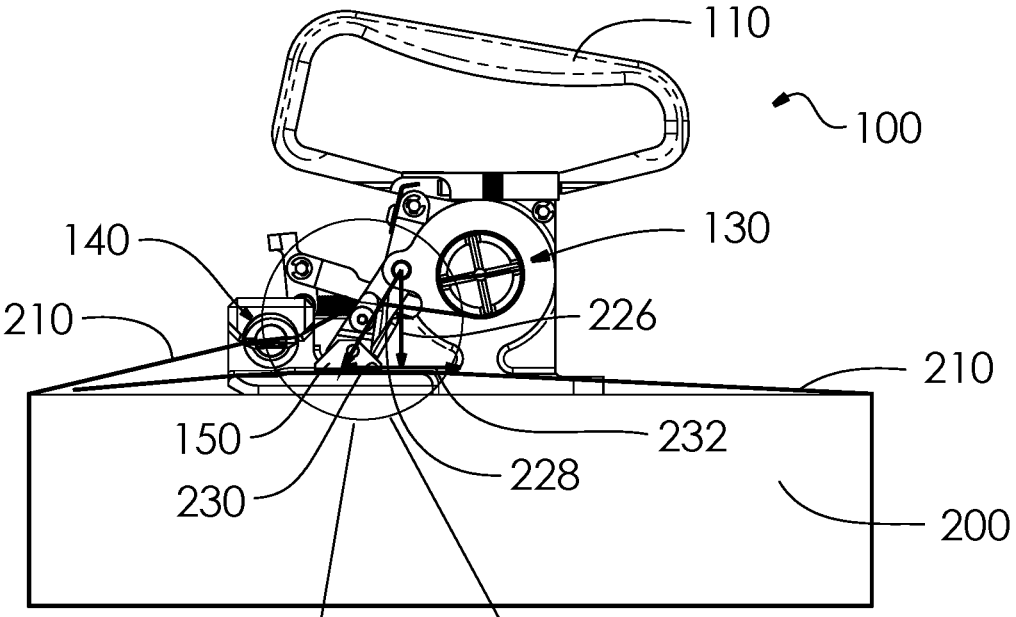
FIG. 10 is another left side view of the example strapping tensioning tool in operation showing vectors representing forces associated with the lower portion of the strapping.
Figure 11:
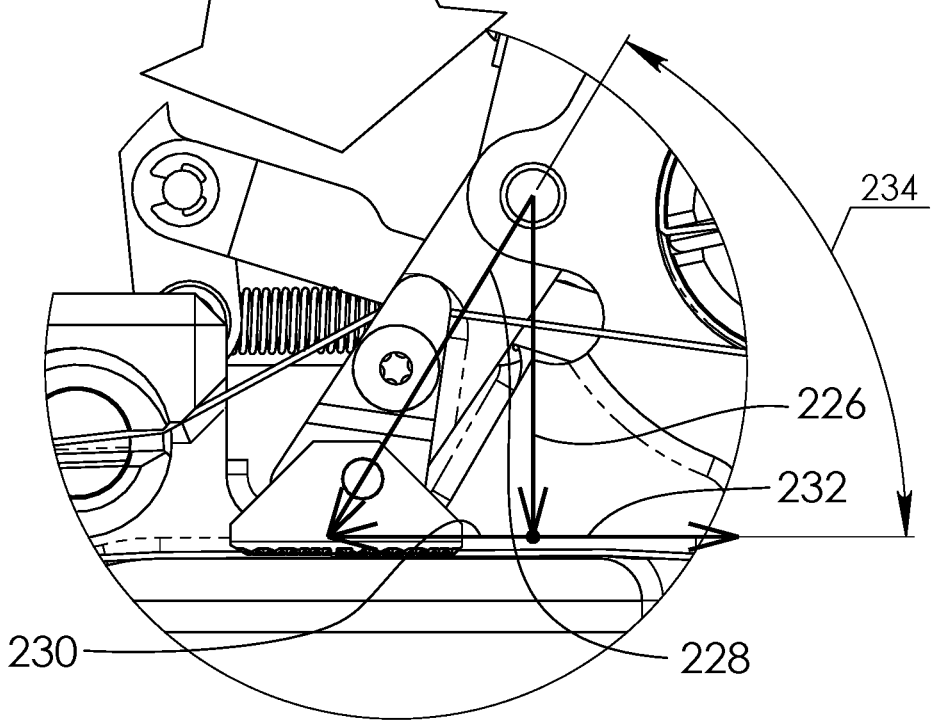
FIG. 11 is an enlarged portion of the left side view of the example strapping tensioning tool in FIG. 10, wherein the force vectors associated with the lower portion of the strapping are shown in greater detail.

FIG. 10 is another left side view of the example strapping tensioning tool 100 that illustrates the forces in operation showing vectors representing forces associated with the lower portion of the strapping 210. As more clearly shown in the enlarged view of FIG. 11, the forces associated with the lower portion of strapping 210 are depicted as vectors 226, 228, 230, and 232. The strapping portion running under gripper foot 150 applies the horizontal tensile force depicted as vector 232, and the gripper foot 150 applies the generally equally and opposite horizontal reaction force depicted as vector 230 (i.e., the horizontal strap holding force 230 of the gripper foot 150). The horizontal tensile force 232 is equal in magnitude to the tensile forces 220, 224 described above. The diagonal force vector 228 represents the force exerted by the gripper 150, 152 on the lower portion of strapping 210. The vertical force vector 226 is the vertical component of the gripper force, while the horizontal force vector 230 is the horizontal component of the gripper force. In FIG. 11, the angle 234 is the angle that the gripper holder 152 makes with the base 120 of the strapping tensioning tool 100 (i.e., the angle of the gripper holder 152 relative to the top surface of the base 120).

Figure 9:
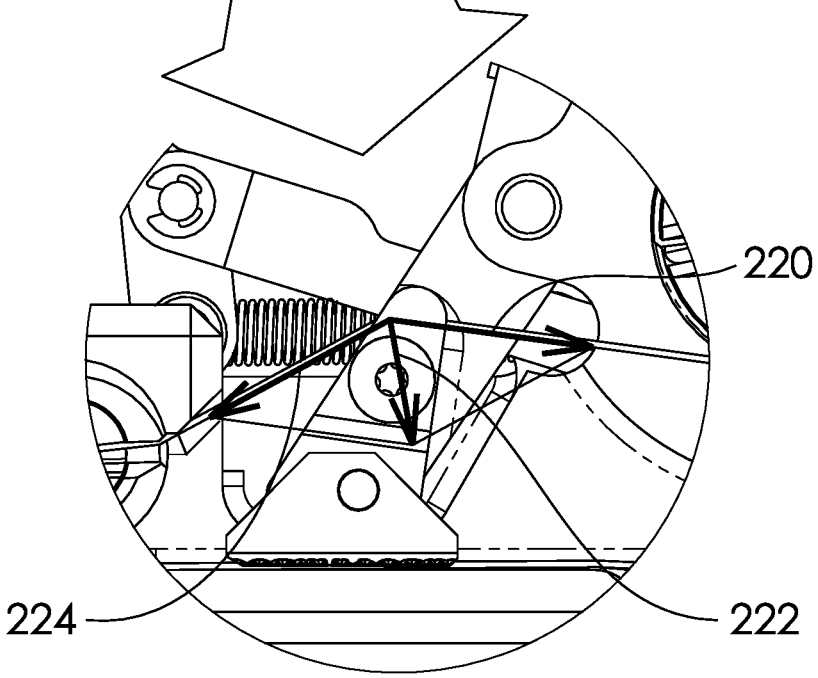
FIG. 9 is an enlarged portion of the left side view of the example strapping tensioning tool in FIG. 8, wherein the force vectors associated with the upper portion of the strapping are shown in greater detail.

FIG. 9 is an enlarged detail view of the gripper 150, 152 with a superimposed vector diagram illustrating the forces applied by the upper portion of strapping 210 to gripper holder 152 of the strapping tensioning tool 100. FIG. 11 is another enlarged detail view of the gripper 150, 152 with a vector diagram illustrating the forces associated with the lower portion of the strapping 210.

Two aspects of the example strapping tensioning tool 100 result in the forces illustrated by vectors 226 and 228 being less than the forces applied by prior art strapping tensioning tools. The first aspect of example tool 100 that reduces such forces is the relative positioning, from front to back, of the cutter, the gripper and the windlass. The second aspect of example tool 100 that reduces such forces is the angle 234 formed by the gripper holder 152 relative to the base 120, namely the angle 234 being approximately 45-55 degrees, instead of the roughly 60-65 degree angle of prior art strapping tensioning tools. Advantageously, the reduction in the angle 234 formed by the gripper holder 152 relative to the base 120 of the example tool 100 makes it easier to lift the gripper 150, 152 after the strap is cut because the applied vertical force 226 is lower than prior art strapping tensioning tools. Thus, by using the example tool 100, the user is able to remove the tool 100 from the strap 210 with significantly less effort after the strap 210 is cut.

In the example strapping tensioning tool 100, the shape of the gripper holder allows the tool 100 to create an additional vertical force using the upper strap. More particularly, during a tensioning operation, the tool 100 is configured such that a lower portion of a strap 210 passes underneath the gripper and an upper portion of the strap 210 passes over the gripper (see FIGS. 8 and 10). The upper portion of the strap 210 is configured to apply a vertical force to the top surface of the gripper holder 152 during the tensioning operation performed on the strap 210 such the vertical force applied by the upper portion of the strap 210 on the gripper 150, 152 supplements a primary vertical force applied to the lower portion of the strap 210 by the gripper 150, 152, thereby reducing the primary vertical force that is required to be applied by the gripper 150, 152 to hold the strap 210 in place during the tensioning operation. Unlike conventional tools in which the gripper works alone to hold the strap, the example tool 100 uses the supplemental vertical force 222 to reduce the primary vertical force applied by the gripper 150, 152. Advantageously, the additional vertical force 222 applied from the upper portion of the strap 210 to the gripper holder 152 allows the lifting effort to be minimized when the motor 160 lifts the gripper 150, 152 after upper portion of the strap 210 is cut. Also, advantageously, the overall footprint of the example tool 100 under the strap 210 is significantly smaller as compared to conventional tools.

Although the invention has been shown and described with respect to a certain embodiment or embodiments, it is apparent that this invention can be embodied in many different forms and that many other modifications and variations are possible without departing from the spirit and scope of this invention.

Moreover, any of the features or attributes of the above described embodiments and variations can be used in combination with any of the other features and attributes of the above described embodiments and variations as desired.

Furthermore, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

While the devices, systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2d. Ed. 1995).

What is claimed is:

1. A strapping tool, comprising:

a gripper;

a windlass having a strap slot;

a cutter; and a base comprising a front and a rear, and the base configured to receive the gripper, the windlass and the cutter, the base further configured to retain the gripper, the windlass and the cutter disposed in relation to one another such that the cutter is closest to the front of the base, the windlass is closest to the rear of the base and the gripper is disposed between the cutter and the windlass;

wherein the tool is configured such that a lower portion of a strap passes underneath the gripper and an upper portion of the strap passes upwardly and over the gripper, downwardly towards the windlass, and then through the strap slot of the windlass, the upper portion of the strap configured to apply a vertical force to the gripper during a tensioning operation performed on the strap such that the vertical force applied by the upper portion of the strap on the gripper supplements a primary vertical force applied to the lower portion of the strap by the gripper, thereby reducing the primary vertical force that is required to be applied by the gripper to hold the strap in place during the tensioning operation.

2. The strapping tool according to claim 1, wherein the gripper comprises a gripper holder and a gripper foot, the upper portion of the strap configured to pass over the gripper holder, and the upper portion of the strap configured to apply the vertical force to the gripper holder during the tensioning operation.

3. The strapping tool according to claim 1, further comprising a motor operatively coupled to the windlass and the cutter, the motor configured to rotate in a first direction so as to apply tension to the strap by rotating the windlass, and the motor further configured to rotate in a opposite, second direction to actuate the cutter so as to cut the strap after the tensioning of the strap.

4. The strapping tool according to claim 3, wherein the motor is further operatively coupled to the gripper, the motor configured to lift the gripper after the strap is cut by rotating further in the second direction.

5. A strapping tool, comprising:

a gripper;

a tensioning mechanism;

a cutter; and a base configured to receive the gripper and the cutter, the base further configured to retain the gripper in relation to the base such that the gripper forms an angle of between 45-55 degrees with respect to a strapping surface of the base;

wherein the tool is configured such that a lower portion of a strap passes underneath the gripper and an upper portion of the strap passes upwardly and over the gripper, and then downwardly towards the tensioning mechanism, the upper portion of the strap configured to apply a vertical force to the gripper during a tensioning operation performed on the strap such that the vertical force applied by the upper portion of the strap on the gripper supplements a primary vertical force applied to the lower portion of the strap by the gripper, thereby reducing the primary vertical force that is required to be applied by the gripper to hold the strap in place during the tensioning operation.

6. The strapping tool according to claim 5, wherein the gripper comprises a gripper holder and a gripper foot, the upper portion of the strap configured to pass over the gripper holder, and the upper portion of the strap configured to apply the vertical force to the gripper holder during the tensioning operation.

7. The strapping tool according to claim 5, further comprising a a motor operatively coupled to the tensioning mechanism and the cutter, the motor configured to rotate in a first direction so as to apply tension to the strap by rotating the tensioning mechanism, and the motor further configured to rotate in a opposite, second direction to actuate the cutter so as to cut the strap after the tensioning of the strap.

8. The strapping tool according to claim 7, wherein the motor is further operatively coupled to the gripper, the motor configured to lift the gripper after the strap is cut by rotating further in the second direction.

9. A strapping tool, comprising:

a gripper;

a tensioning mechanism; and a base configured to receive the gripper and the tensioning mechanism;

wherein the tool is configured such that a lower portion of a strap passes underneath the gripper and an upper portion of the strap passes upwardly and over the gripper, and then downwardly towards the tensioning mechanism, the upper portion of the strap configured to apply a vertical force to the gripper during a tensioning operation performed on the strap such that the vertical force applied by the upper portion of the strap on the gripper supplements a primary vertical force applied to the lower portion of the strap by the gripper, thereby reducing the primary vertical force that is required to be applied by the gripper to hold the strap in place during the tensioning operation.

10. The strapping tool according to claim 9, wherein the base is further configured to retain the gripper in relation to the base such that the gripper forms an angle of between 45-55 degrees with respect to a strapping surface of the base.

11. The strapping tool according to claim 9, wherein the gripper comprises a gripper holder and a gripper foot, the upper portion of the strap configured to pass over the gripper holder, and the upper portion of the strap configured to apply the vertical force to the gripper holder during the tensioning operation.

12. The strapping tool according to claim 9, further comprising a motor operatively coupled to the gripper and the tensioning mechanism, the motor configured to rotate in a first direction so as to apply tension to the strap by rotating the tensioning mechanism, and the motor further configured to rotate in a opposite, second direction to lift the gripper after the strap is cut.

13. The strapping tool according to claim 12, wherein the vertical force applied to the gripper by the upper portion of the strap is zero after the strap is cut, thereby facilitating the lifting of the gripper by the motor.

* * * * *